United States Patent [19]

Owens et al.

[11] Patent Number: 4,959,251

[45] Date of Patent: Sep. 25, 1990

[54] ELASTIC PATCH FOR HOLES IN WALLS

[76] Inventors: R. Larry Owens, 5121 E. Shore Dr., Conyers, Ga. 30208; Paul G. McClellan, 1795 Mackinaw Pl., Smyrna, Ga. 30080

[21] Appl. No.: 262,703

[22] Filed: Oct. 26, 1988

Related U.S. Application Data

[63] Continuation-in-part of Ser. No. 95,433, Sep. 11, 1987, abandoned.

[51] Int. Cl.[5] ..... B32B 7/06; B32B 7/12; B32B 3/02

[52] U.S. Cl. ..... 428/41; 428/43; 428/63; 428/64; 52/514

[58] Field of Search ..... 428/63, 41, 43, 40, 428/64, 66; 52/514

[56] References Cited

U.S. PATENT DOCUMENTS 2,833,327 5/1958 Boyce ..... 428/63 X 3,009,846 11/1961 Gruber ..... 428/63 X

*Primary Examiner*—Alexander S. Thomas

[57] ABSTRACT

An elastic patch for the repair of a hole in an interior wall. This patch is easy to apply and requires no tools. The patch has a pressure sensitive adhesive backing which can be affixed to the wall surrounding the hole. Peripheral portions of the patch are thinner than that portion of the patch disposed over the hole itself. This tapering in the thickness of the patch allows it to be blended in with the rest of the wall so that when the patch is covered with paint, the patch becomes unnoticeable and at the same time this tapering gives the patch a thick central region where strength is needed. A material having a high elasticity is used for the patch so that it can absorb shocks to the wall and then spring back to its original shape, thereby preventing any reoccurrence of damage in the area of the wall protected by the patch.

5 Claims, 1 Drawing Sheet

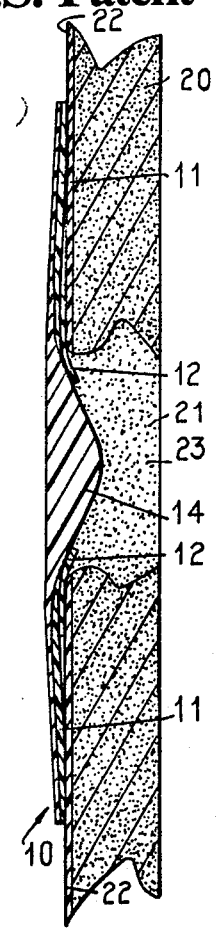
Fig. 1.
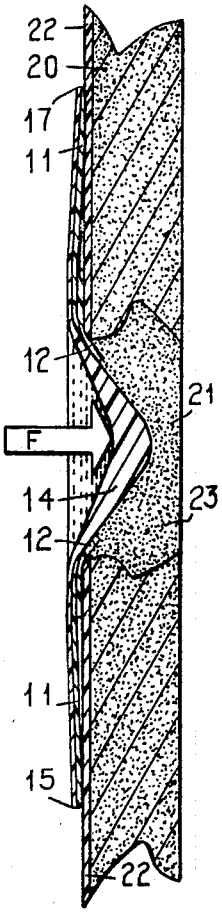
Fig. 2.
Fig. 4.
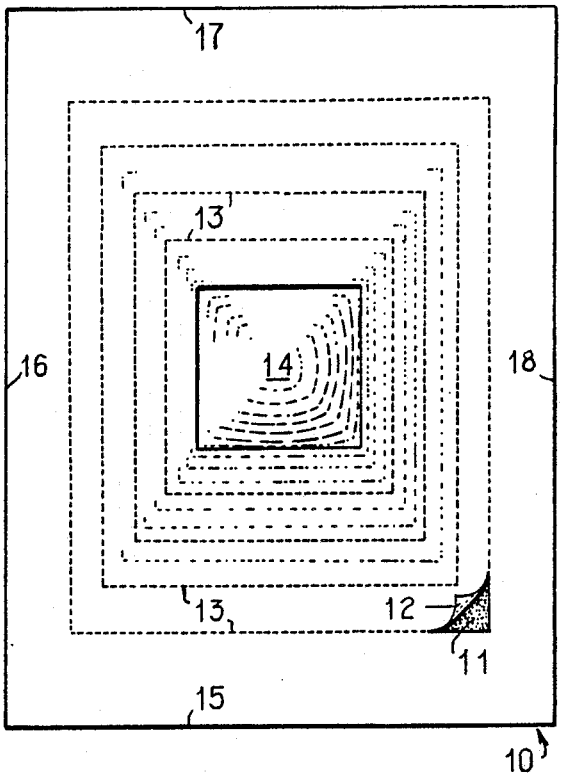
Fig. 3.
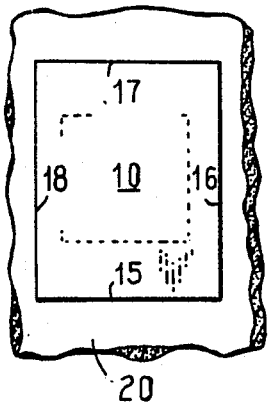
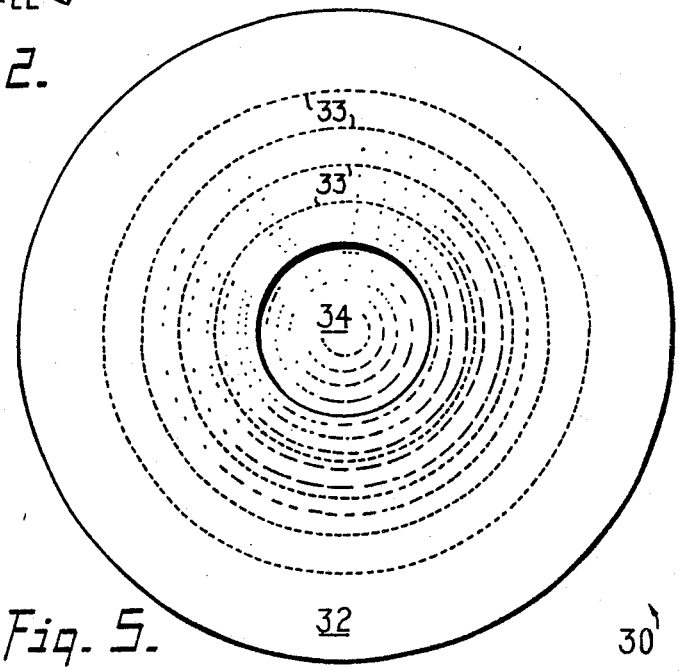
Fig. 5.

ELASTIC PATCH FOR HOLES IN WALLS

CROSS-REFERENCE TO RELATED APPLICATION

This application is a continuation-in-part of application, Ser. No. 095,433, filed Sept. 11, 1987, now abandoned, titled "PREFORMED LAMINATE PATCH AND A METHOD OF MAKING SUCH PATCH FOR CRACKS AND HOLES IN SURFACES", R. Larry Owens, inventor.

BACKGROUND OF THE INVENTION

The invention relates to the repair and patching of damaged interior walls such as drywall, sometimes called Sheetrock. Typical dry wall construction involves the attachment of drywall to two by four studs on 16 inch centers. The dry wall is a material made of plaster of Paris or the like sandwiched between carboard inner and outer surfaces. The mateial is quite brittle and may be easily damaged by a sharp blow from even a blunt object such as a door handle or the corners of a piece of furniture.

The traditional method of repair of holes in drywall includes placing a backing plate behind the drywall and then filling in the hole with a spackling compound or with plaster of Paris. This method of repair requires a plurality of steps that span several days in time. First the original filling needs a day or so to dry and on drying some shrinkage usually occurs. The patch must then be sanded and a second layer used to level the hole. After another day or so elapses, the patch on the wall is finally ready to paint.

In order to simplify the patching of holes in drywall construction, drywall patches have been invented. Hoffmann, U.S. Pat. No. 4,135,017, discloses a patch strengthened by a thin gage aluminum sheet which can be bonded to a wall using a two-sided adhesive tape. The exterior surface of Hoffmann's patch is covered with a fibrous material of sufficient porosity to allow a wall finishing compound to be bonded to it. To effect a smooth and invisible repair, one usually must apply a thin coating of plaster to this fibrous material. The Hoffmann invention, although offering an improvement over past methods, still requires a long time delay while the coating of plaster on the patch dries. Furthermore, if an area covered by Hoffmann's patch is struck, its thin metal substrate will probably deform permanently and therefore need to be repaired.

SUMMARY OF THE INVENTION

The invention is directed toward those working in the area of making repairs of small holes in interior walls who wish to apply a patch and immediately paint over it without having to wait or return the following day to finish the job. Furthermore, the present invention answers the needs of those obliged to repair household and office areas in which a particular section of a wall is constantly being damaged by ordinary use. The improved elastic patch for dry wall is thus superior to any devices used formerly for the repair of damaged walls.

The elastic patch, which is capable of returning to its original flat shape after an impact, includes a two-sided pressure sensitive adhesive tape on the back surface of the patch. The extent to which the tape is exposed to the wall once the patch is affixed thereto is important in determining whether the patch actually returns to its original shape. In use, a portion of the pressure sensitive adhesive tape disposed proximate the edges of any opening concealed by the patch must remain protected with a cover. A cover with perforations is provided to facilitate a user's removing sections of the cover which are not needed for such edge protection and which would interfere with affixing the patch if they were left in place. All the dry wall mechanic is required to do is select the proper sized patch and peal off a section of its protective cover so that each inner edge of the adhesive tape thus exposed can be disposed slightly outwardly of the proximate edge of the opening to be covered in the wall. The user then applies a light pressure to the patch to stick it to the wall.

The preferred elastic patch is thiciker in its center for strength and sound proofing and tapers toward its edges so that it can be blended into the wall. The edges of the patch are sufficiently thin that a single coat of paint applied to the patch and surrounding wall makes the patch virtually unnoticeable. Furthermore, the patch can be painted immediately after installation and is made of an elastic material that holds the paint tightly, once it has dried, even when it is flexed. Thus the patch not only enables a user to repair the damaged wall quickly but also gives insurance against the need to re-repair the damaged area in the future. The subject invention is directed to improvements over the applicant's prior teaching by way of providing a material that not only is elastic but also has great tenacity for retaining a paint coating even when flexed. Moreover, with the inclusion of a thickened mid-section, the patch is both strengthened and given additional sound proofing capability. Further, an elastic material which lacks components likely to attack the adhesive tape bond has also been incorporated into the improved combination giving it a longer life expectancy.

BRIEF DESCRIPTION OF THE DRAWINGS

FIG. 1 shows a side view of the elastic patch according to the present invention attached over a damaged area of a typical drywall;

FIG. 2 shows a side view of the elastic patch according to the present invention attached over a damaged area of a typical drywall during the application of a stress to the patch;

FIG. 3 shows a plan view on a reduced scale of the exterior face of a rectangular embodiment of the elastic patch according to FIG. 1 affixed to a fragmentary section of drywall;

FIG. 4 shows a plan view of the interior face of a rectangular embodiment of the present invention, a portion of the protective skin being folded back for clarity of illustration; and FIG. 5 shows a plan view of an interior face of a circular embodiment of the present invention.

DESCRIPTION OF THE PREFERRED EMBODIMENTS

Referring now to the drawings, an elastic patch according to the present invention is indicated generally by the reference numeral 10. The patch 10 has a two-sided pressure sensitive adhesive tape 11 which covers one side of the patch except for a mid-section 14 (FIG. 4). Alternately, one side of the patch 10 except for the midsection 14 can be coated with pressure sensitive adhesive film (not shown).

Prior to use, the entire adhesive tape 11 is protected by a removable skin 12. In use, only a portion of the skin 12 remains (FIGS. 1 and 2). The skin 12 has perforations 13 that make it easy for one to remove sections of the skin. For a wall 20 with a damaged area 21, the skin 13 is preferably removed only in the area of the patch 10 that is larger than an opening 23 of the damaged area. Unless the exposed portion of the adhesive tape 11 is kept away from the opening 23, there would be a tendency, whenever the patch is pushed into the opening, for the patch to adhere to the sides thereof, leaving an impression of the outline of the opening visible in the repaired wall.

As best seen in FIG. 1, the elastic patch is thicker in the mid-section 14 and tapers towards its peripheral edges 15, 16, 17, 18. Typical dimensions are: in the mid-section 14, a maximum thickness of 375 mil; and a thickness of one mil at the edges 15, 16, 17, 18. The thin edges 15, 16, 17, 18 allow the patch 10 to be blended into the wall 20 with the application of a single coat (not shown) of paint atop a pre-existing paint covering 22.

The patch 10 is preferably fabricated of an elastic material such as a polyvinyl chloride manufactured under the trademark "POLYVIN" or the like which can be painted with either latex or oil based paints and which has little tendency to leach out plasticizers over time. Moreover, the adhesive in the tape 11 when the elastic material is made of polyvinyl chloride is preferably acrylic-based for compatibility. The elastic material is preferably treated to have a Type A durometer hardness between 10 to 90 with 65 being the optimum as tested in ASDTMD2240 and an elongation from 50% to 800% as specified in ASDTMD412. The elasticity of the patch 10 is indicated in the drawings in which FIG. 1 shows the patch 10 on the wall 20 before a force is applied and FIG. 2 shows the patch being stretched during the application of a force F. When the force is removed, the patch 10 reverts to its resting position (FIG. 1).

The preferred embodiment of the patch 10 is rectangular in shape as shown in FIG. 3 to facilitate painting the patch with conventional paint rollers. But for some applications, such as patching a hole in a wall made by the collision of a door knob (not shown) with it, a patch 30 having a circular shape is preferred (FIG. 5). In this alternate embodiment, a skin 34 having perforations 33 concentric with a circular mid-section 34 is provided.

What is claimed:

1. A patch for a hole in a wall comprising:

(a) a generally flat elastic body portion having its greatest thickness in the mid-section thereof, the body portion tapering to its minimum thickness at least one edge of the body portion;

(b) a pressure sensitive adhesive layer attached to said body portion;

(c) a protective cover, attached to the exposed surface of said adhesive layer, which is perforated delineating sections of the cover so that a region of the adhesive layer can be uncovered which is larger than the hole.

2. A patch according to claim 1 wherein the body portion is further characterized as being formed of an elastic material which is a blend of polyvinyl chloride which has little tendency to leach out plasticizers.

3. A patch according to claim 2 wherein the elastic material is further characterized as having a Type A durometer hardness between 10 to 90 as tested in ASDTMD2240 and an elongation from 50% to 800% as specified in ASDTMD412.

4. A patch for an hole in a wall comprising a generally flat body portion, the body portion varying in thickness, the center of the body being the thickest and the edges thereof being the thinnest, the body portion being formed of an elastic material that regains its shape even after undergoing a large distortion; a pressure sensitive adhesive layer attached to said body portion; and a protective cover, attached to the exposed surface of said adhesive layer, which is perforated, delineating sections of the cover so that a region of the adhesive layer spaced from the hole can be uncovered.

5. A patch according to claim 4 wherein the elastic material is sufficiently porous and has sufficiently great tenacity for paint that the material can hold a paint film dried on the body portion even when the body portion is stetched due to impact.

* * * * *